US007708581B2

(12) United States Patent
Weiss

(10) Patent No.: US 7,708,581 B2
(45) Date of Patent: May 4, 2010

(54) REPLACEMENT CLIP AND METHOD FOR REPAIRING A MODULAR CABLE CONNECTOR HAVING A BROKEN LOCKING CLIP

(75) Inventor: Daniel B. Weiss, Brentwood, MO (US)

(73) Assignee: International Business Machines Corporation, Armonk, NY (US)

( * ) Notice: Subject to any disclaimer, the term of this patent is extended or adjusted under 35 U.S.C. 154(b) by 30 days.

(21) Appl. No.: 12/061,492

(22) Filed: Apr. 2, 2008

(65) Prior Publication Data

US 2009/0253305 A1 Oct. 8, 2009

(51) Int. Cl.
*H01R 4/50* (2006.01)

(52) U.S. Cl. ..... 439/344; 439/385

(58) Field of Classification Search ..... 439/290, 439/344, 354, 357; 174/117 A
See application file for complete search history.

(56) References Cited

U.S. PATENT DOCUMENTS 3,794,953 A * 2/1974 Malin ..... 439/329
4,884,981 A * 12/1989 Chandler et al. ..... 439/607.41
4,990,102 A * 2/1991 Myers ..... 439/452
5,334,044 A * 8/1994 Falossi et al. ..... 439/491
5,346,405 A * 9/1994 Mosser et al. ..... 439/188
5,562,475 A * 10/1996 Kern et al. ..... 439/344
5,638,474 A * 6/1997 Lampert et al. ..... 385/78
5,666,408 A 9/1997 Lao
5,697,815 A 12/1997 Drewnicki
6,116,958 A 9/2000 Reichle
6,269,471 B1 * 7/2001 Yamano et al. ..... 716/13
6,290,543 B1 9/2001 Plummer, Jr. et al.
6,325,636 B1 * 12/2001 Hipp et al. ..... 439/61
6,340,313 B1 1/2002 Hwang
6,520,796 B1 * 2/2003 Reichle ..... 439/491
6,619,989 B1 * 9/2003 Yi ..... 439/607.48
6,688,910 B1 * 2/2004 Macauley ..... 439/491
6,758,601 B2 * 7/2004 Holmquist ..... 385/75
6,890,197 B2 * 5/2005 Liebenow ..... 439/188
7,156,683 B2 1/2007 Gupta et al.
7,361,047 B2 * 4/2008 Strahl ..... 439/354
7,431,604 B2 * 10/2008 Waters et al. ..... 439/344
7,540,756 B1 * 6/2009 Strahl ..... 439/354
2004/0132348 A1 * 7/2004 Haggay et al. ..... 439/719
2005/0106918 A1 * 5/2005 Colantuono et al. ..... 439/290
2009/0042424 A1 * 2/2009 Kaneda ..... 439/159
2009/0130917 A1 * 5/2009 Lloyd ..... 439/701

* cited by examiner

*Primary Examiner*—T C Patel
*Assistant Examiner*—Harshad C Patel
(74) *Attorney, Agent, or Firm*—John Pivnichny; Law Office of Jim Boice

(57) ABSTRACT

A replacement clip and method for repairing a modular cable connector having a broken locking clip. The replacement clip comprises a substantially u-shaped housing being configured to mount onto a modular connector having a broken clip, the housing having a top surface and a bottom surface opposite from the top surface, the top surface having an arm extension ending in a locking tab, the locking tab being spaced by the arm extension and located at an end opposite from the cable that the connector is connected to, the bottom surface having a slit therein running parallel to the cable, the slit being configured to mount the replacement clip onto the connector, such that, the locking tab securely holds the connector within a socket and such that mechanical and electrical connections between the connector and the socket are maintained.

17 Claims, 4 Drawing Sheets

REPLACEMENT CLIP AND METHOD FOR REPAIRING A MODULAR CABLE CONNECTOR HAVING A BROKEN LOCKING CLIP

FIELD OF THE INVENTION

The present invention relates to computer systems and software, and more specifically to a replacement clip or latch and a method for repairing or restoring a broken molded flexible latch coupled to a male modular plug or connector.

BACKGROUND OF THE INVENTION

In today's business environment, computers are usually connected to some type of network in order to share resources. Examples of such networks include the Internet, Wide Area Networks (WANs) and Local Area Networks (LANs). In order to tap into a network such as a LAN, a client computer must be coupled to the LAN either wirelessly (e.g., via an 802.11x router) or through hard wiring. A popular hard wiring system utilizes modular connectors, such as, the RJ45 connectors.

Reference is now made to FIGS. 1A and 1B, which depict a prior art modular plug or connector 100A and 100B, respectively. Further, FIGS. 2A and 2B, reference numerals 200A and 200B, respectively, illustrate a profile of a prior art modular plug or connector plugged into a female connector. Turning to FIG. 1A, reference numeral 100A, a cable 106 terminates in a male connector, such as, a male RJ45 (Registered Jack-45) plug 104. The male RJ45 plug 104 has a molded flexible latch 102. Referring to FIGS. 2A and 2B, reference numeral 200A of FIG. 2A illustrates the exterior perimeter profile of a male plug or connector 104 corresponding with the respective interior perimeter profile of a female receptacle housing 1164. In FIGS. 2A and 2B, a male plug or connector 104 is plugged into a female receptacle or port 1160 (shown in FIG. 2B) within a receptacle housing 1164, such that, the flexible latch mechanism (referenced as numeral 102 in FIG. 2A) is located proximate to a top surface of the receptacle housing 1164. The details of the male connector as plugged into the receptacle housing is further shown in FIG. 2B. As shown in reference numeral 200B of FIG. 2B, the male plug or connector 104 that is mounted onto a cable 106 is pushed or plugged into the female receptacle 1160 and is held within the receptacle housing 1164 by a catch mechanism or lip 1166 (shown in FIGS. 2A and 2B), which is located proximate to a top surface within the receptacle housing 1164. The catch mechanism 1166 of the receptacle housing 1164 engages the protrusion portion 101 of the molded flexible latch 102 of the male connector to securely hold the male plug or connector within the receptacle housing 1164. Further, as shown in FIG. 1B, reference numeral 100B, the molded flexible latch 102 (shown in FIGS. 1A and 1B) of the male connector or plug 104 breaks, as shown by the broken latch 202 in FIG. 1B. As such, the wires within the male plug 104 may not establish mechanical and electrical connections when the male plug 104 is plugged into a female receptacle or port 1160 (shown in FIG. 2B), thus, needing to be replaced. Replacing the male plug 104 is extremely difficult, given that it entails replacing the fine gauge of wires leading from cable 106 to pins 108 (shown in FIG. 1A) within the male plug 104. Due to the difficulty in repairing a cable 104 with a broken molded flexible latch 202, typically, the entire cable 104 is discarded and replaced with a new cable, which can be costly.

SUMMARY OF THE INVENTION

In one aspect, the invention provides a method for repairing or restoring a cable having a modular plug with a broken locking clip. The method includes providing a replacement clip having an anchor section configured to anchor the replacement clip onto a body of the modular plug having a broken locking clip, the modular plug being affixed to a cable, a surface of the anchor section having a bridge section extending therefrom, the bridge section having a locking tab spaced by the bridge section and being located at an end opposite from the anchor section, the locking tab being configured to securely hold the modular plug having the broken locking clip within a socket, when the modular plug with the replacement clip is plugged into the socket, mounting the anchor section of the replacement clip onto a cable-end of the modular plug having the cable affixed thereon, wherein the anchor section anchors the replacement clip to the cable-end of the modular plug and wherein the locking tab is proximate to a respective surface of the broken locking clip of the modular plug and plugging the modular plug with the replacement clip mounted thereon into the socket, wherein the modular plug with the replacement clip securely attaches the modular plug within the socket and wherein mechanical and electrical connections between the modular plug and the socket are maintained. In an embodiment, the providing step includes providing the replacement clip having the bridge section extending from the anchor section, the anchor section having a bottom surface that is configured to contact a bottom surface of the modular plug when the anchor section is mounted onto the modular plug, the bottom surface of the modular plug being opposite from a top surface of the modular plug having the broken locking clip and wherein the bottom surface of the anchor section includes a slit configured to mount onto the cable-end of the modular plug having the cable affixed thereto. In an embodiment, the mounting step includes aligning the slit of the replacement clip with the top surface of the modular plug having the broken locking clip, wherein the slit is aligned substantially parallel to the cable affixed to the modular plug and wherein pushing the slit around the cable-end of the modular plug mounts the replacement clip onto the cable-end of the modular plug. In an embodiment, the anchor section of the replacement clip includes a shape and a size that is configured to accommodate and to securely hold the cable-end of the modular plug having the cable affixed thereto and wherein the locking tab of the replacement clip is configured to engage an interior lip of the socket for securely holding the modular plug into the socket. In an embodiment, a bottom side of the top surface of the anchor section further includes an adhesive secured to the bottom side of the top surface of the anchor section and includes a removable covering for securing the anchor section to the top side of the modular connector having the broken locking clip. Further, in an embodiment, the modular plug includes at least one of: an RJ-45 (Registered Jack-45) connector, an RJ-11 (Registered Jack-11) or an 8P8C (8 positions, 8 conductors) connector. In an embodiment, the replacement clip includes at least one of: a single piece constructed from an injection molding process or a single piece stamped out of plastic.

In another aspect, the invention provides a replacement clip or replacement cable connector clip for repairing a modular connector having a broken locking clip. The replacement clip includes a housing having a substantially u-shape configuration and being configured to mount onto a cable-end of a modular connector that is secured to a cable, the housing having a top surface that is connected to two opposite side surfaces, the two opposite side surfaces being spaced apart from each other by the top surface and being substantially parallel to each other and being configured to mount onto the cable-end of the modular connector, the top surface of the housing includes an arm extending from the top surface, the arm having a locking tab spaced by the arm and located at an end opposite from the cable-end of the modular connector, the locking tab being configured to securely hold the modular connector within a socket and, such that, mechanical and electrical connections between the modular connector and the socket are maintained. In an embodiment, the housing further includes a bottom surface opposite from the top surface and having a slit therein, the slit running parallel to the cable secured to the modular connector and wherein the slit around the cable-end of the modular connector is configured to mount the replacement clip onto the cable-end of the modular connector. In an embodiment, the two opposite side surfaces of the housing contact respective opposite sides of the modular connector when the replacement clip is mounted onto the modular connector and wherein the top surface of the housing presses securely against a top side of the modular connector having the broken locking clip. In an embodiment, the modular connector having the replacement clip mounted thereon is plugged into the socket, such that, the locking tab is securely held against an interior lip of the socket, securely locking the modular connector into the socket. In an embodiment, the modular connector plugged into the socket engages the locking tab into an interior lip of the socket and wherein electrical terminals in the modular connector establish electrical connections with electrical terminals in the socket. In an embodiment, the housing includes a shape and a size that is configured to accommodate and to securely hold the cable-end of the modular connector having the cable secured thereto. In an embodiment, a bottom side of the top surface of the housing further includes an adhesive secured to the bottom side of the top surface of the housing and includes a removable covering for securing the housing to the top side of the modular connector having the broken locking clip. In an embodiment, the modular connector includes at least one of: an RJ-45 (Registered Jack-45) connector, an RJ-11 (Registered Jack-11) or an 8P8C (8 positions, 8 conductors) connector. In an embodiment, the replacement clip includes at least one of: a single piece constructed from an injection molding process or a single piece stamped out of plastic.

In yet another aspect, the invention provides a Local Area Network (LAN) coupled to a plurality of computers via modular sockets and modular plugs, wherein at least one modular plug has a broken locking clip and wherein the modular plug is repaired with a replacement clip that includes a housing being configured to mount onto a cable-end of a modular plug having a cable secured thereto, the modular plug having a broken locking clip, the housing having an anchor section configured to anchor the replacement clip onto the cable-end of the modular plug, the anchor section having a bridge section extending therefrom and having a locking tab spaced by the bridge section and being located at an end opposite from the anchor section, the locking tab being configured to securely hold the modular connector within a socket and where mechanical and electrical connections between the modular connector and the modular socket are maintained. In an embodiment, the housing includes a substantially u-shape configuration, the housing having an opening on a bottom surface that is configured to mount onto the cable-end of the modular plug having the cable secured thereto, the opening being parallel to the cable secured to the modular plug and wherein the opening around the cable-end of the modular plug mounts the replacement clip onto the cable-end of the modular plug. In an embodiment, the housing further includes two opposite side surfaces that are configured to contact respective opposite sides of the modular plug when the replacement clip is mounted onto the modular plug and wherein a top surface of the housing is proximate to a top side of the modular plug having the broken locking clip located on the top side of the modular plug. In an embodiment, the modular plug having the replacement clip mounted thereon when plugged into the socket engages the locking tab into an interior lip of the socket, securely locking the modular plug into the socket and wherein electrical terminals in the modular plug establish electrical connections with electrical terminals in the socket. In an embodiment, the housing of the replacement clip includes a shape and a size that is configured to accommodate and to securely hold the cable-end of the modular plug affixed to the cable. In an embodiment, the top surface of the anchor section of the housing further includes an adhesive secured to a bottom side of the top surface of the anchor section and wherein the adhesive further includes a removable covering for securing the anchor section to the top side of the modular plug having the broken locking clip. In an embodiment, the modular plug includes at least one of: an RJ-45 (Registered Jack-45) connector, an RJ-11 (Registered Jack-11) connector or an 8P8C (8 positions, 8 conductors) connector. In an embodiment, the replacement clip includes at least one of: a single piece constructed from an injection molding process or a single piece stamped out of plastic.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Figure 1A:
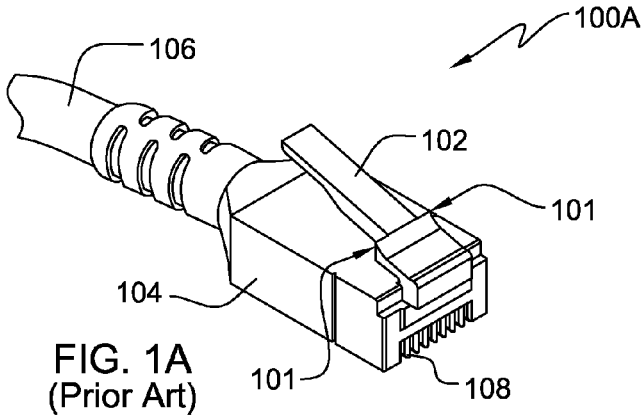
FIG. 1A (Prior Art)
FIG. 1A depicts a prior art male modular plug or connector with a molded flexible latch.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

In one embodiment, the invention provides a replacement clip for repairing or restoring a modular connector having a broken locking clip. The replacement clip includes a housing having a substantially u-shape configuration and being configured to mount onto a cable-end of a modular connector that is secured to a cable, the housing having a top surface that is connected to two opposite side surfaces, the two opposite side surfaces being spaced apart from each other by the top surface and being substantially parallel to each other and being configured to mount onto the cable-end of the modular connector, the top surface of the housing includes an arm extending from the top surface, the arm having a locking tab spaced by the arm and located at an end opposite from the cable-end of the modular connector, the locking tab being configured to securely hold the modular connector within a socket and, such that, mechanical and electrical connections between the modular connector and the socket are maintained. In an embodiment, the housing further includes a bottom surface opposite from the top surface and having a slit therein, the slit running parallel to the cable secured to the modular connector and wherein the slit around the cable-end of the modular connector is configured to mount the replacement clip onto the cable-end of the modular connector. In an embodiment, the two opposite side surfaces of the housing contact respective opposite sides of the modular connector when the replacement clip is mounted onto the modular connector and wherein the top surface of the housing presses securely against a top side of the modular connector having the broken locking clip. In an embodiment, the modular connector having the replacement clip mounted thereon is plugged into the socket, such that, the locking tab is securely held against an interior lip of the socket, securely locking the modular connector into the socket. In an embodiment, the modular connector plugged into the socket engages the locking tab into an interior lip of the socket and wherein electrical terminals in the modular connector establish electrical connections with electrical terminals in the socket. In an embodiment, the housing includes a shape and a size that is configured to accommodate and to securely hold the cable-end of the modular connector having the cable secured thereto. In an embodiment, a bottom side of the top surface of the housing further includes an adhesive secured to the bottom side of the top surface of the housing and includes a removable covering for securing the housing to the top side of the modular connector having the broken locking clip. In an embodiment, the modular connector includes at least one of: an RJ-45 (Registered Jack-45) connector, an RJ-11 (Registered Jack-11) or an 8P8C (8 positions, 8 conductors) connector. In an embodiment, the replacement clip includes at least one of: a single piece constructed from an injection molding process or a single piece stamped out of plastic.

Figure 1B:
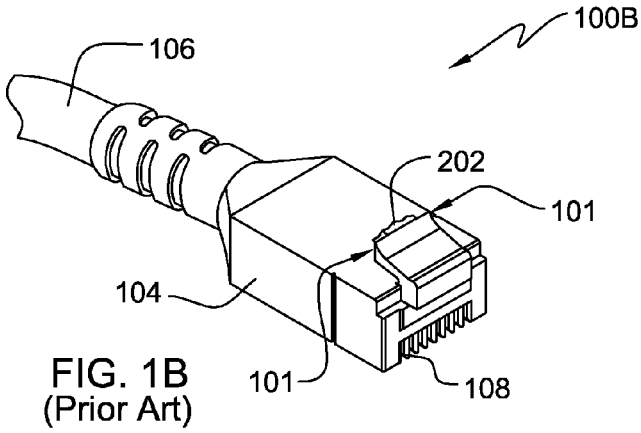
FIG. 1B (Prior Art)
FIG. 1B depicts a prior art male modular plug or connector with a broken molded flexible latch.
Figure 2A:
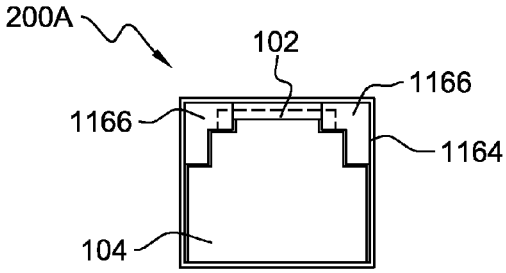
FIG. 2A (Prior Art)
FIG. 2A depicts an exterior perimeter profile of a prior art male modular plug or connector with a molded flexible latch plugged into a female connector within a receptacle housing.
Figure 2B:
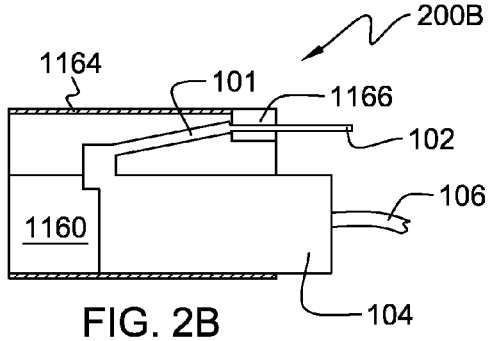
FIG. 2B (Prior Art)
FIG. 2B depicts a side view of a prior art male modular plug or connector with a molded flexible latch plugged into a female connector within a receptacle housing.
Figure 3:
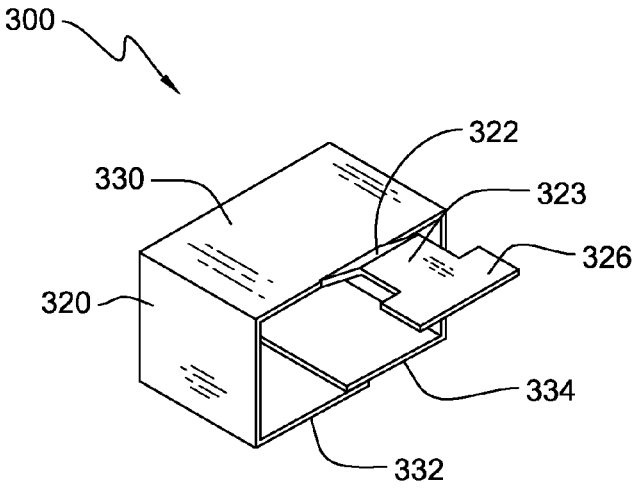
FIG. 3 depicts a perspective view of an embodiment of an inventive replacement clip or latch, in accordance with an embodiment of the present invention.
Figure 4:
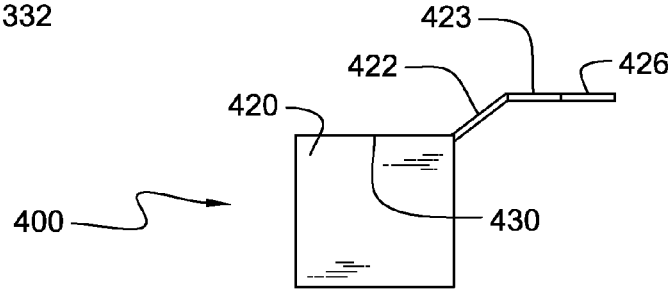
FIG. 4 depicts a side view of an embodiment of an inventive replacement clip or latch, in accordance with an embodiment of the present invention.

Reference is now made to FIGS. 3 and 4, which together depict an embodiment of a replacement clip or latch or replacement cable connector clip 300 and 400, respectively, for repairing or restoring a modular plug or connector (reference numeral 104 in FIG. 1) mounted on a cable (reference numeral 106 in FIG. 1), where the modular plug or connector has a broken locking clip or latch (reference numeral 202 in FIG. 1B), in accordance with an embodiment of the invention. In particular, reference numeral 300 in FIG. 3 depicts a perspective view diagram of a replacement clip or latch 300 for repairing or restoring a modular plug mounted onto a cable and which has a broken locking clip, whereas, reference numeral 400 of FIG. 4 depicts a side view diagram of a replacement clip or latch 400 for repairing or restoring a modular plug or connector having a broken locking clip, in accordance with an embodiment of the invention. Turning to FIGS. 3 and 4, the replacement clip 300 comprises of an anchor section 320 (reference numeral 420 in FIG. 4) that is mounted onto a cable-end of the modular plug having a broken locking clip, that is, the replacement clip 300 is mounted on to the end of the modular plug that is proximate to the cable, as discussed further herein below with respect to FIGS. 9 and 10. In an embodiment, as shown in FIGS. 3 and 4, a top surface 330 (in FIG. 3) and 430 (in FIG. 4) of the anchor section 320 and 420, respectively, of the replacement clip has a bridge or arm section (reference numerals 322 and 323 in FIG. 3 and reference numerals 422 and 423 in FIG. 4) that extends from the anchor section. Further, as shown in FIGS.

Figure 9:
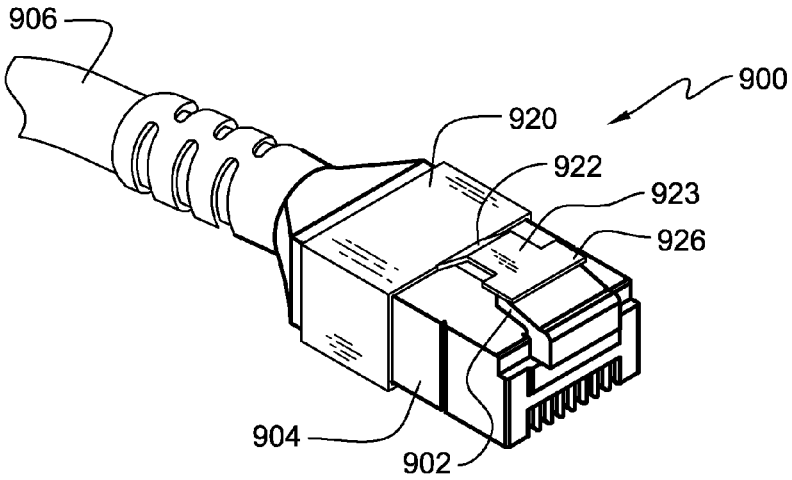
FIG. 9 depicts a perspective view of an embodiment of an inventive replacement clip or latch coupled to a male modular plug or connector with a broken molded flexible latch, in accordance with an embodiment of the invention.
Figure 10:
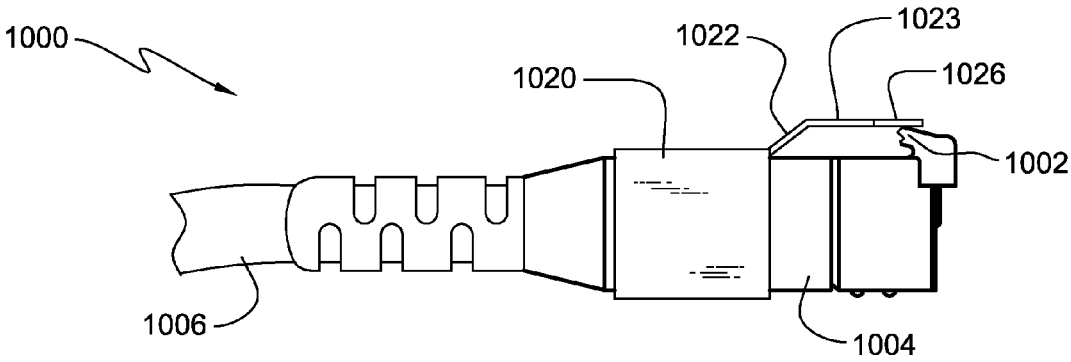
FIG. 10 depicts a side view of an embodiment of an inventive replacement clip or latch coupled to a male modular plug or connector with a broken molded flexible latch, in accordance with an embodiment of the invention.

3 and 4, the bridge section 323 (in FIG. 3) and 423 in FIG. 4) culminates in a locking tab 326 and 426, respectively, where the locking tab is spaced from the anchor section 320 (420 in FIG. 4) by the bridge section 322 and 323 in FIG. 3 and 422 and 423 in FIG. 4. In particular, a first part of the bridge section (reference numeral 322 in FIG. 3 and reference numeral 422 in FIG. 4) is shown as being bent upward at an angle from a top surface 330 and 430, respectively, of the anchor section 320 and 420, respectively, whereas, the bridge section 323 in FIG. 3 and 423 in FIG. 4 is shown constructed on the same plane as the locking tab 326 and 426, respectively. It is understood by one skilled in the art that although, the bridge section is shown as being constructed of two distinct sections 322 and 323 in FIG. 3 (422 and 423 in FIG. 4), it is understood that the bridge section may be constructed of a single flexible material that can be flexed or bent for securing the bridge section of the replacement clip against a broken locking clip of a modular plug when the replacement clip is mounted on the modular plug and is plugged into a receptacle or socket in order to establish mechanical and electrical connections between the modular plug and the socket or receptacle that the modular plug is plugged into. Further, referring to FIG. 3, the anchor section 320 has a bottom surface that has a slit that results in two bottom sections or pieces, namely, reference numerals 332 and 334, which in an embodiment, overlap each other. The bottom surfaces 332 and 334 of the replacement clip are located opposite to and substantially parallel to the top surface 320, with the bottom surface being configured to contact a bottom surface of the modular plug when the anchor section of the replacement clip is mounted onto the modular plug, as shown in FIGS. 9 and 10.

Figure 5:
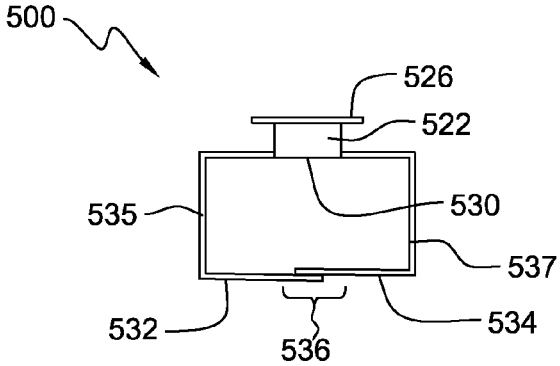
FIG. 5 depicts a front view of an embodiment of an inventive replacement clip or latch, in accordance with an embodiment of the present invention.
Figure 6:
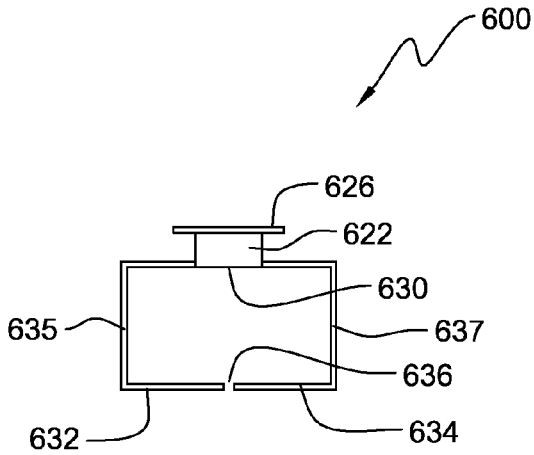
FIG. 6 depicts a front view of an alternate embodiment of an inventive replacement clip or latch, in accordance with an embodiment of the present invention.

Reference is now made to FIGS. 5 and 6, which show a tab end cross-sectional view of different embodiments of a replacement clip, in accordance with the invention. In particular, as shown in FIGS. 5 and 6, each of the replacement clips 500 and 600, respectively, has a substantially u-shaped configuration that is configured to mount or snap onto a modular connector that is secured to a cable, the modular connector having a broken locking clip. Each of the replacement clips 500 and 600, respectively, has a locking tab 526 and 626 that extends from the arm or bridge section 522 and 622, where each of the respective bridge sections 522 and 622 extends from a respective top surface 530 and 630 of the replacement clip. Further, in an embodiment, as shown in FIGS. 5 and 6, the replacement clip has two opposing side sections (reference numerals 535 and 537 in FIG. 5 and reference numerals 635 and 637 in FIG. 6) that extend from the top surfaces 530 and 630, respectively. The side sections further extend into a bottom surface, opposite from the top surface of the anchor section. The anchor section of the replacement clip is substantially rectangular in shape and is configured to correspond to the shape of a modular plug, so that the replacement clip can be secured onto the modular plug having a broken locking clip. In an embodiment, as shown in FIG. 5, the bottom section has a slit that divides the bottom surface into sections 532 and 534, but has a configuration where the bottom sections 532 and 534 overlap each other in the middle, as shown by reference numeral 536. In another embodiment, as shown in FIG. 6, the replacement clip 600 has a bottom surface that has a slit 636 that divides the bottom surface into sections 632 and 634, but has a configuration where the bottom sections 632 and 634 do not overlap each other as shown in FIG. 5. It is understood by one skilled in the art that other configurations can be used for the replacement clip for the purpose of facilitating mounting or attaching of the replacement clip onto a modular plug affixed to a cable.

Figure 7:
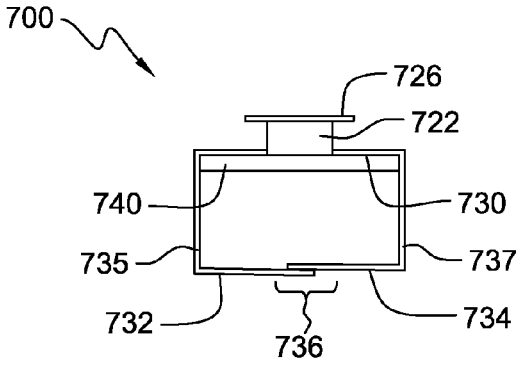
FIG. 7 depicts a front view of an embodiment of an inventive replacement clip or latch having an adhesive material attached to an inside top surface of the inventive replacement clip or latch, in accordance with an embodiment of the present invention.
Figure 8:
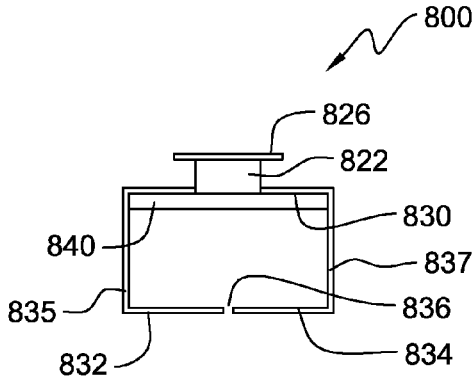
FIG. 8 depicts a front view of an alternate embodiment of an inventive replacement clip or latch having an adhesive material attached to an inside top surface of the inventive replacement clip or latch, in accordance with an embodiment of the present invention.

Reference is now made to FIGS. 7 and 8, which show different embodiments of a replacement clip, in accordance with the invention. In particular, as shown in FIGS. 7 and 8, the replacement clip 700 and 800, respectively, has a substantially u-shaped configuration that is configured to mount onto a body of the modular connector that is secured to a cable. Each of the respective replacement clips 700 and 800 has a respective locking tab 726 and 826 that extends from the respective bridge section 722 and 822, where each of the respective bridge sections 722 and 822 extends from a respective top surface 730 and 830 of the replacement clip. Further, in an embodiment, as shown in FIGS. 7 and 8, the replacement clip has two opposing side sections (reference numerals 735 and 737 in FIG. 7 and reference numerals 835 and 837 in FIG. 8) that extend from the top surface 730 and 830, respectively. The side sections further extend into a bottom surface opposite to and substantially parallel to the top surface of the anchor section. The anchor section of the replacement clip is substantially rectangular in shape and is configured to correspond to the shape of a modular plug, so that the replacement clip can be secured onto the modular plug or connector that is secured to a cable. In an embodiment, as shown in FIG. 7, the bottom section has a slit that divides the bottom surface into sections 732 and 734, but where the configuration is such that the bottom sections 732 and 734 overlap each other in the middle, as shown by reference numeral 736. In another embodiment, as shown in FIG. 8, the replacement clip 800 has a bottom surface that has a slit 836 that divides the bottom surface into sections 832 and 834, but has a configuration where the bottom sections 832 and 834 do not overlap each other as shown in FIG. 7. In an embodiment, as shown in FIGS. 7 and 8, a respective top surface 730 and 830 of each of the different embodiments has an adhesive layer 740 and 840, respectively, secured to a bottom side of the top surface of the replacement clip 700 and 800, respectively. The adhesive layer, in an embodiment, has a removable covering such that the anchor section of the replacement clip secures the replacement clip to a top surface of the modular plug or connector secured to a cable. It is understood by one skilled in the art that other configurations can be used for the replacement clip for the purpose of facilitating mounting or attaching of the replacement clip onto a modular plug.

In another embodiment, the invention provides a method for repairing or restoring a cable having a modular plug with a broken locking clip. The method includes providing a replacement clip having an anchor section configured to anchor the replacement clip onto a body of the modular plug having a broken locking clip, the modular plug being affixed to a cable, a surface of the anchor section having a bridge section extending therefrom, the bridge section having a locking tab spaced by the bridge section and being located at an end opposite from the anchor section, the locking tab being configured to securely hold the modular plug having the broken locking clip within a socket, when the modular plug with the replacement clip is plugged into the socket, mounting the anchor section of the replacement clip onto a cable-end of the modular plug having the cable affixed thereon, wherein the anchor section anchors the replacement clip to the cable-end of the modular plug and wherein the locking tab is proximate to a respective surface of the broken locking clip of the modular plug and plugging the modular plug with the replacement clip mounted thereon into the socket, wherein the modular plug with the replacement clip securely attaches the modular plug within the socket and wherein mechanical and electrical connections between the modular plug and the socket are maintained. In an embodiment, the providing step includes providing the replacement clip having the bridge section extending from the anchor section, the anchor section having a bottom surface that is configured to contact a bottom surface of the modular plug when the anchor section is mounted onto the modular plug, the bottom surface of the modular plug being opposite from a top surface of the modular plug having the broken locking clip and wherein the bottom surface of the anchor section includes a slit configured to mount onto the cable-end of the modular plug having the cable affixed thereto. In an embodiment, the mounting step includes aligning the slit of the replacement clip with the top surface of the modular plug having the broken locking clip, wherein the slit is aligned substantially parallel to the cable affixed to the modular plug and wherein pushing the slit around the cable-end of the modular plug mounts the replacement clip onto the cable-end of the modular plug. In an embodiment, the anchor section of the replacement clip includes a shape and a size that is configured to accommodate and to securely hold the cable-end of the modular plug having the cable affixed thereto and wherein the locking tab of the replacement clip is configured to engage an interior lip of the socket for securely holding the modular plug into the socket. In an embodiment, a bottom side of the top surface of the anchor section further includes an adhesive secured to the bottom side of the top surface of the anchor section and includes a removable covering for securing the anchor section to the top side of the modular connector having the broken locking clip. Further, in an embodiment, the modular plug includes at least one of: an RJ-45 (Registered Jack-45) connector, an RJ-11 (Registered Jack-11) or an 8P8C (8 positions, 8 conductors) connector. In an embodiment, the replacement clip includes at least one of: a single piece constructed from an injection molding process or a single piece stamped out of plastic.

Reference is now made to FIGS. 9 and 10, which show a replacement clip (as described herein above with respect to FIGS. 1 through 6) that is mounted onto a body of a respective male modular plug or connector 904 and 1004, for instance, an RJ45 plug or connector 904 and 1004, whose respective original molded flexible latch 902 and 1002 has been broken off. In particular, reference numeral 900 in FIG. 9 shows a perspective view of a replacement clip mounted onto a modular plug having a broken locking clip or latch, whereas, reference numeral 1000 in FIG. 10 shows a side view of a replacement clip mounted onto a modular plug having a broken locking clip or latch. As depicted in FIGS. 9 and 10, the anchor section 920 of the replacement clip (reference numeral 1020 in FIG. 10) is secured towards the cable end (reference numeral 906 in FIG. 9 and reference numeral 1006 in FIG. 10) of the modular plug 904 (reference numeral 1004 in FIG. 10). As shown, the bridge portion (922 and 923 in FIG. 9 and 1022 and 1023 in FIG. 10) which extends from a top surface of the anchor section culminates in the tab section 926 (in FIG. 9) and 1026 (in FIG. 10). In particular, the respective tab section 926 (in FIG. 9) and 1026 (in FIG. 10) abut against or presses against a top surface of the broken clip or latch 902 (in FIG. 9) and 1002 (in FIG. 10) of the respective modular plug 904 and 1004, such that, when the modular plug or connector with the replacement clip mounted thereon is plugged into a receptacle or socket, the replacement clip securely attaches the modular plug within the socket and the locking tab of the replacement clip establishes mechanical and electrical connections between the modular plug and the socket, as explained further herein below with respect to FIGS. 11A-11C.

Figure 11A:
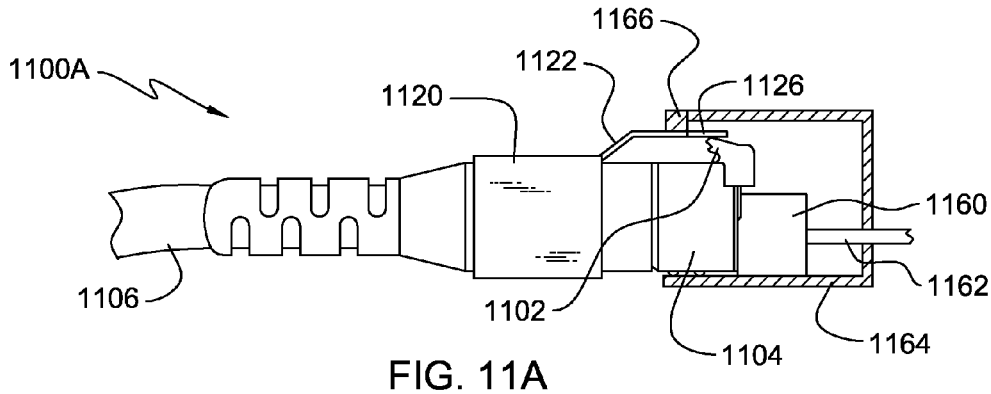
FIG. 11A depicts a side view embodiment of an inventive replacement clip or latch coupled to a male modular plug or connector with a broken molded flexible latch that is coupled to a female modular plug or connector within a receptacle housing, in accordance with an embodiment of the invention.
Figure 11B:
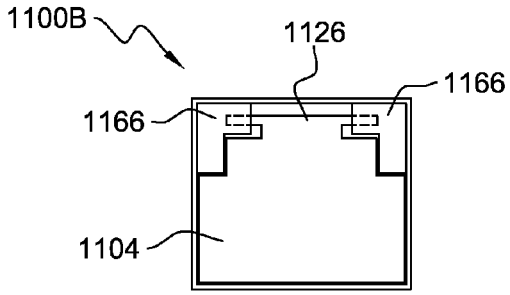
FIG. 11B illustrates an exterior perimeter profile of an inventive replacement clip or latch coupled to a male modular plug or connector with a broken molded flexible latch that is coupled to a female modular plug or connector within a receptacle housing, in accordance with an embodiment of the invention.
Figure 11C:
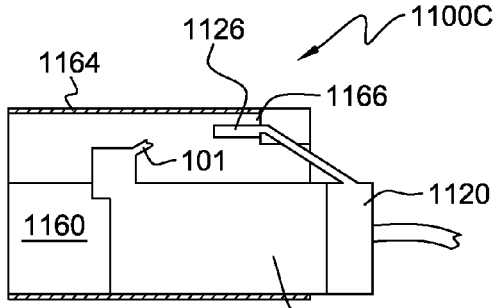
FIG. 11C illustrates a side view embodiment of an inventive replacement clip or latch coupled to a male modular plug or connector with a broken molded flexible latch that is coupled to a female modular plug or connector within a receptacle housing, in accordance with an embodiment of the invention.

Reference is now made to FIG. 11A, where reference numeral 1100A shows an anchor section 1120 of a replacement clip (as described herein above with respect to FIGS. 9 and 10) that is mounted onto a body of a male modular plug or connector 1104 that is secured to a cable 1106. Further, FIG. 11A shows that the original molded flexible latch 1102 of the modular plug 1104 is broken off and that the modular plug or connector 1104 now has the replacement clip mounted thereon and that the modular plug with the replacement clip is plugged into a female socket or receptacle 1160 enclosed within a receptacle housing 1164. The female socket or receptacle 1160 is a corresponding counterpart to the male modular plug or connector and includes mechanical connections within the socket 1160 itself and includes electrical connections terminating in an electrical cable 1162, such that, when the male modular plug 1104 is plugged into the female socket 1160, mechanical and electrical connections can be established. As shown in FIG. 11, the locking tab 1126 of the replacement clip is spaced apart from the anchor section 1120 of the replacement clip by an arm or bridge section 1122. In particular, the locking tab 1126 of the replacement clip presses against the molded flexible latch or broken locking clip 1102, such that, when the modular plug with the replacement clip is plugged into the socket, the locking tab 1126 of the replacement clip engages an interior lip 1166 of the receptacle housing 1164, thus, securely holding the modular plug 1104 within the socket 1164. Referring to FIG. 11B, reference numeral 1100B illustrates an exterior perimeter profile of a male modular plug 1104 having a replacement clip and that is mounted within a female receptacle housing 1166. In particular, as shown in FIG. 11B, a locking tab 1126 of the replacement clip attached to the modular plug 1104 that is plugged into the receptacle housing is located proximate to a top surface of the female receptacle housing 1166. Further, referring to FIG. 11C, reference numeral 1100C shows a side view of the embodiment shown in FIG. 11B, where a male modular plug 1104 having a replacement clip 400 (as discussed with respect to FIG. 4) mounted thereon is plugged into a female receptacle housing 1166. As shown in FIGS. 11B and 11C, the locking tab 1126 engages an interior lip or catch mechanism 1166 located on a top surface of the housing 1164, thus, securely holding the modular plug 1104 having a replacement clip 40 within the socket 1164 and ensuring that proper electrical and mechanical connections between the male plug and the female plug 1160 are established.

In yet another embodiment, the invention provides a Local Area Network (LAN) coupled to a plurality of computers via modular sockets and modular plugs, wherein at least one modular plug has a broken locking clip and wherein the modular plug is repaired with a replacement clip that comprises a housing being configured to mount onto a cable-end of a modular plug having a cable secured thereto, the modular plug having a broken locking clip, the housing having an anchor section configured to anchor the replacement clip onto the cable-end of the modular plug, the anchor section having a bridge section extending therefrom and having a locking tab spaced by the bridge section and being located at an end opposite from the anchor section, the locking tab being configured to securely hold the modular connector within a socket and where mechanical and electrical connections between the modular connector and the modular socket are maintained. In an embodiment, the housing includes a substantially u-shape configuration, the housing having an opening on a bottom surface that is configured to mount onto the cable-end of the modular plug having the cable secured thereto, the opening being parallel to the cable secured to the modular plug and wherein the opening around the cable-end of the modular plug mounts the replacement clip onto the cable-end of the modular plug. In an embodiment, the housing further includes two opposite side surfaces that are configured to contact respective opposite sides of the modular plug when the replacement clip is mounted onto the modular plug and wherein a top surface of the housing is proximate to a top side of the modular plug having the broken locking clip located on the top side of the modular plug. In an embodiment, the modular plug having the replacement clip mounted thereon when plugged into the socket engages the locking tab into an interior lip of the socket, securely locking the modular plug into the socket and wherein electrical terminals in the modular plug establish electrical connections with electrical terminals in the socket. In an embodiment, the housing of the replacement clip includes a shape and a size that is configured to accommodate and to securely hold the cable-end of the modular plug affixed to the cable. In an embodiment, the top surface of the anchor section of the housing further includes an adhesive secured to a bottom side of the top surface of the anchor section and wherein the adhesive further includes a removable covering for securing the anchor section to the top side of the modular plug having the broken locking clip. In an embodiment, the modular plug includes at least one of: an RJ-45 (Registered Jack-45) connector, an RJ-11 (Registered Jack-11) connector or an 8P8C (8 positions, 8 conductors) connector. In an embodiment, the replacement clip includes at least one of: a single piece constructed from an injection molding process or a single piece stamped out of plastic.

Figure 12:
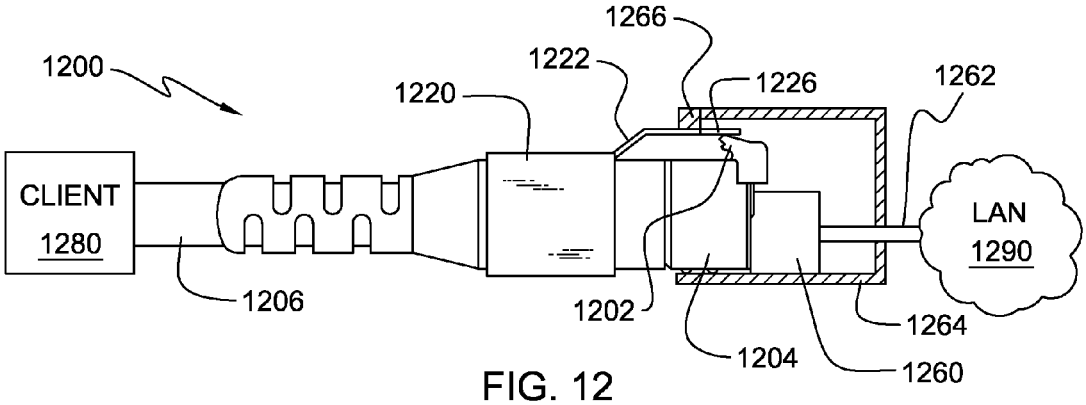
FIG. 12 depicts a side view of an embodiment of a Local Area Network (LAN) that uses the inventive replacement clip or latch coupled to a male modular plug or connector with a broken molded flexible latch that is coupled to a female modular plug or connector, in accordance with an embodiment of the invention.

Reference is now made to FIG. 12, where reference numeral 1200 depicts a client computer or system or computer system 1280 coupled to a cable 1206 that terminates at a male modular plug or connector 1204. As used herein, the term "computer" or "system" or "computer system" or "computing device" includes any data processing system including, but not limited to, personal computers, servers, workstations, network computers, main frame computers, routers, switches, Personal Digital Assistants (PDAs), telephones and any other system capable of processing, transmitting, receiving, capturing and/or storing data. As shown in FIG. 12, an anchor section 1220 of a replacement clip is mounted onto the body of the male modular plug or connector 1204, where the original molded flexible latch 1202 of the modular plug 1204 has been broken off. Further, FIG. 12 shows that the modular plug having the replacement clip attached thereto is plugged into or coupled to a modular female connector or socket or receptacle 1260 enclosed within a receptacle housing 1264. The female socket or receptacle 1260 is a corresponding counterpart to the male modular plug or connector 1204 and includes mechanical connections within the socket 1260 itself and includes electrical connections terminating in an electrical cable 1262, such that, when the male modular plug 1204 is plugged into the female socket 1260, mechanical and electrical connections can be established. As shown in FIG. 12, the locking tab 1226 of the replacement clip is spaced apart from the anchor section 1220 of the replacement clip by an arm or bridge section 1222. In one embodiment, the locking tab 1226 of the replacement clip presses against the molded flexible latch or broken locking clip 1202, such that, when the modular plug 1204 with the replacement clip is plugged into the socket 1260, the locking tab 1226 of the replacement clip engages an interior lip 1266 of the receptacle housing 1264, thus, securely holding the modular plug 1204 within the socket. Further, FIG. 12 shows that the female connector or socket 1260 is coupled via cable 1262 to a LAN (Local Area Network) 1290. As shown in FIG. 11C, it is understood that the locking tab 1226 of the replacement clip does not have to contact the broken locking clip 101 in order to hold the male connector securely within the receptacle housing 1164, but in an embodiment, the locking tab 1126 is proximate to the broken locking clip 101 and engages the catch mechanism or lip 1166, thus, securely holding the male connector 1104 within the receptacle housing 1164 in order to establish electrical connections between the male connector 1104 and the female connector 1160.

In addition, while the present invention has been discussed in the context of repairing or restoring a broken clip or latch on a male modular plug or connector, such as, the RJ45 (Registered Jack-45) connector, it is equally useful with an RJ11 (Registered Jack-11) male connector or an 8P8C (8 positions, 8 conductors) connector. In an embodiment, the replacement clip is a single piece that is constructed from an injection molding process. Alternatively, the replacement clip may be constructed from a single piece stamped out of plastic. It is understood by one skilled in the art that the replacement clip can be constructed of any material that is sufficiently flexible to mount onto the modular plug. Further, it is understood by one skilled in the art that the anchor section of the replacement clip can be configured in many different ways, depending on the modular plug or connector being repaired, so as to be easily mountable onto a modular plug and for securely holding the modular plug into the female receptacle. For instance, the anchor section of the replacement clip may be designed with just three sides, a top surface and two opposite side surfaces and without a bottom surface, where an inside surface of the top surface of the anchor section has an adhesive for securing the replacement clip to the modular plug. Alternatively, the anchor section of the replacement clip may have a bottom surface with a bigger slit for facilitating mounting of the replacement clip onto the modular plug. Furthermore, it is understood by one skilled in the art that the bridge or arm section extending from the anchor section of the replacement clip can be configured in many different ways, depending on the modular connector or plug being repaired, so as to be easily mountable onto the modular plug or connector and so as to securely hold the modular plug into the female receptacle.

The foregoing descriptions of specific embodiments of the present invention have been presented for the purpose of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A replacement clip for repairing a modular connector having a broken locking clip, comprising:

a housing having a substantially u-shape configuration and being configured to mount onto a cable-end of a modular connector that is secured to a cable, said housing having a top surface that is connected to two opposite side surfaces, said two opposite side surfaces being spaced apart from each other by said top surface and being substantially parallel to each other and being configured to mount onto said cable-end of said modular connector, said top surface of said housing comprising an arm extending from said top surface, said arm having a locking tab spaced by said arm and located at an end opposite from said cable-end of said modular connector, said locking tab being configured to securely hold said modular connector within a socket by causing said broken locking clip to press against a side of said locking tab, wherein said broken locking clip pressing against the side of said locking tab causes the locking tab to press against an interior lip of the socket such that the cable is securely coupled to said socket, and wherein mechanical and electrical connections between said modular connector and said socket are maintained.

2. The replacement clip according to claim 1, wherein said housing further comprises a bottom surface opposite from said top surface and having a slit therein, said slit running parallel to said cable secured to said modular connector and wherein said slit around said cable-end of said modular connector is configured to mount said replacement clip onto said cable-end of said modular connector.

3. The replacement clip according to claim 2, wherein said two opposite side surfaces of said housing contact respective opposite sides of said modular connector when said replacement clip is mounted onto said modular connector and wherein said top surface of said housing presses securely against a top side of said modular connector having said broken locking clip.

4. The replacement clip according to claim 3, wherein said modular connector having said replacement clip mounted thereon is plugged into said socket, and wherein said locking tab is securely held against an interior lip of said socket, securely locking said modular connector into said socket.

5. The replacement clip according to claim 4, wherein said modular connector plugged into said socket engages said locking tab into said interior lip of said socket, and wherein electrical terminals in said modular connector establish electrical connections with electrical terminals in said socket.

6. The replacement clip according to claim 5, wherein said housing comprises a shape and a size that is configured to accommodate and to securely hold said cable-end of said modular connector having said cable secured thereto.

7. The replacement clip according to claim 6, wherein a bottom side of said top surface of said housing further comprises an adhesive secured to said bottom side of said top surface of said housing and comprises a removable covering for securing said housing to said top side of said modular connector having said broken locking clip.

8. The replacement clip according to claim 7, wherein said modular connector is an 8P8C (8 positions, 8 conductors) connector.

9. The replacement clip according to claim 8, wherein said replacement clip comprises at least one of: a single piece constructed from an injection molding process and a single piece stamped out of plastic.

10. A Local Area Network (LAN) coupled to a plurality of computers via modular sockets and modular plugs, wherein at least one modular plug has a broken locking clip and wherein said at least one modular plug is repaired with a replacement clip that comprises:

a housing being configured to mount onto a cable-end of a modular plug having a cable secured thereto, said modular plug having a broken locking clip, said housing having an anchor section configured to anchor said replacement clip onto said cable-end of said modular plug, said anchor section having a bridge section extending therefrom and having a locking tab spaced by said bridge section and being located at an end opposite from said anchor section, wherein said locking tab securely holds said modular plug within a modular socket of said modular sockets by causing said locking tab to press against a top surface of a broken locking clip on the cable-end of the modular connector that is secured to the cable, and wherein mechanical and electrical connections between said modular plug and said modular socket are maintained.

11. The LAN of claim 10, wherein said housing comprises a substantially u-shape configuration, said housing having an opening on a bottom surface that is configured to mount onto said cable-end of said modular plug having said cable secured thereto, said opening being parallel to said cable secured to said modular plug and wherein said opening being configured to mount said replacement clip onto said cable-end of said modular plug.

12. The LAN of claim 11, wherein said housing further comprises two opposite side surfaces that are configured to contact respective opposite sides of said modular plug when said replacement clip is mounted onto said modular plug and wherein a top surface of said housing is proximate to a top side of said modular plug having said broken locking clip located on said top side of said modular plug.

13. The LAN of claim 12, wherein said modular plug having said replacement clip mounted thereon when plugged into said socket engages said locking tab into an interior lip of said socket, securely locking said modular plug into said socket and wherein electrical terminals in said modular plug establish electrical connections with electrical terminals in said socket.

14. The LAN of claim 13, wherein said housing of said replacement clip comprises a shape and a size that is configured to accommodate and to securely hold said cable-end of said modular plug affixed to said cable.

15. The LAN of claim 14, wherein said top surface of said anchor section of said housing further comprises an adhesive secured to a bottom side of said top surface of said anchor section and wherein said adhesive further comprises a removable covering for securing said anchor section to said top side of said modular plug having said broken locking clip.

16. The LAN of claim 15, wherein said modular plug is an 8P8C (8 positions, 8 conductors) connector.

17. The LAN of claim 16, wherein said replacement clip comprises at least one of: a single piece constructed from an injection molding process and a single piece stamped out of plastic.

* * * * *